US005159970A

United States Patent [19]

Burkarth et al.

[11] Patent Number: 5,159,970

[45] Date of Patent: Nov. 3, 1992

[54] METHOD OF MAKING SHELL MOULDS FOR CASTING

[75] Inventors: Nadine Burkarth, Courbevoie; Christian Marty, Boulogne Billancourt; Yvan Rappart, Fontenay-Sous-Bois, all of France

[73] Assignee: Societe Nationale d'Etude et de Construction de Moteurs d'Aviation "S.N.E.C.M.A.", Paris, France

[21] Appl. No.: 554,399

[22] Filed: Jul. 20, 1990

[30] Foreign Application Priority Data

Jul. 20, 1989 [FR] France ..... 89 09760

[51] Int. Cl.[5] ..... B22C 1/00; B22C 9/04; B28B 1/38; B28B 7/36

[52] U.S. Cl. ..... 164/517; 106/38.22; 106/287.11; 264/39; 264/59; 264/60; 264/112; 264/113; 264/221; 264/226; 264/256; 264/305; 264/306; 264/317; 264/337; 264/338; 264/DIG. 57

[58] Field of Search ..... 264/317, 221, 225-227, 264/59, 313, 305, 338, 337, DIG. 57, 333, 245, 246, 256, 39, 301, 306, 112, 113, 60; 164/516, 517; 106/287.11, 38.22

[56] References Cited

U.S. PATENT DOCUMENTS

| | | | |
|---|---|---|---|
| 2,064,143 | 12/1936 | Belton et al. | 264/307 X |
| 2,703,913 | 3/1955 | Hinde et al. | 164/516 |
| 2,908,952 | 10/1959 | Benham . | |
| 2,961,751 | 11/1960 | Operhall et al. | 164/516 X |
| 3,022,196 | 2/1962 | Jenkins | 106/287.11 |
| 3,156,023 | 11/1964 | Hockin | 164/516 |
| 3,396,775 | 8/1968 | Scott | 164/516 |
| 3,747,663 | 7/1973 | Taylor | 164/516 |
| 3,788,895 | 1/1974 | Schimmer et al. | 156/314 X |
| 3,837,876 | 9/1974 | Mayuzumi et al. | 106/287.11 |
| 4,019,558 | 4/1977 | Szabo | 164/516 |
| 4,125,507 | 11/1978 | Kummins et al. | 106/287.11 |
| 4,832,748 | 5/1989 | Tawara et al. | 106/287.11 |

FOREIGN PATENT DOCUMENTS

| | | | |
|---|---|---|---|
| 72329 | 2/1983 | European Pat. Off. | 164/516 |
| 153432 | 9/1985 | European Pat. Off. | 164/517 |
| 251847 | 1/1988 | European Pat. Off. . | |
| 2255977 | 7/1975 | France . | |
| 2599649 | 12/1987 | France . | |
| 15937 | 2/1979 | Japan | 106/287.11 |
| 62869 | 5/1981 | Japan | 106/287.11 |
| 44690 | 3/1982 | Japan | 106/287.11 |
| 1197568 | 8/1989 | Japan | 106/287.11 |
| 865488 | 9/1981 | U.S.S.R. | 164/516 |
| 871998 | 10/1981 | U.S.S.R. | 164/517 |
| 1101317 | 7/1984 | U.S.S.R. | 164/517 |
| 1205986 | 1/1986 | U.S.S.R. | 164/517 |

OTHER PUBLICATIONS

Patent Abstracts of Japan, vol. 9, No. 87 (M-372)[1810], Apr. 17, 1985 & JP-A-59 215 241.

*Primary Examiner*—Karen Aftergut

*Attorney, Agent, or Firm*—Oblon, Spivak, McClelland, Maier & Neustadt

[57] ABSTRACT

A method of making a shell mould, particularly for a lost wax casting operation, includes the deposition of an adhesion agent on the pattern before the deposition of layers of ceramic material to build up the mould. The adhesion agent used is preferably a 3% solution of aminosilane in a solvent consisting of ethanol and ethyl acetate in amounts from 25% to 75% of the solvent. The method avoids the phenomenon of detachment at the pattern/ceramic interface.

9 Claims, No Drawings

METHOD OF MAKING SHELL MOULDS FOR CASTING

BACKGROUND OF THE INVENTION

1. Field of the Invention

The present invention relates to a method of making shell moulds for castings, and is particularly concerned with the manufacture of such moulds for casting processes of the "lost wax" type.

2. Summary of the Prior Art

As is well known, lost wax casting processes using ceramic shell moulds generally comprise the following stages:

making a pattern, usually from wax, of the article which is to be cast;

deposition of a ceramic suspension on the pattern from a thick slip;

deposition of ceramic particles in stucco form;

drying, for example in an oven, to achieve removal of solvent from the suspension, and consolidation of the ceramic layer;

deposition of a further ceramic suspension layer from a fluid slip;

further deposition of ceramic particles in stucco form;

drying as before;

addition of further ceramic layers as necessary to introduce new elements and to obtain the desired mould characteristics for the particular application, be they of a physical, chemical or mechanical nature;

heat treatment of the resulting assembly under specific conditions, adapted to the compositions and products used, leading to the removal of the organic pattern and to a "firing" and consolidation of the mould, in particular by sintering, which may be reactive; and casting the article in the mould so obtained.

Examples of slip composition are given in particular in French Patent 2 599 649.

In the course of using processes such as are generally described above various difficulties have arisen, necessitating special precautions during use. The deposition of the first layer on the wax pattern is found to be a particularly delicate operation. Indeed, it is necessary to use a thick slip to obtain this first layer, to coat it with a deposit of particles and to watch closely the drying conditions to prevent overdrying. All these restricting conditions are necessary to limit the decoherence of the said first layer and to prevent flaking. These difficulties are aggravated particularly when the pattern has areas of limited accessibility, termed "enclosed", and problems of adherence of the ceramic deposit on the wax pattern leading to detachment of the layer appear also at sharp angles or fine sections. These configurations are encountered especially in applications particularly envisaged by the invention, i.e. aircraft components, especially for aeroengines, which have these features, such as, for example, cooled turbine blades.

Attempts at a solution to the problem have generally involved adjusting the compositions of the slips. For example, in the case of known compositions comprising a colloidal binder, surface-active agents, such as nonylphenol based substances, have been added. However, these additions involve a risk of destabilizing the compositions and usually produce a foaming effect, which requires a further addition of an anti-foaming agent.

SUMMARY OF THE INVENTION

With the aim of overcoming the problem without incurring the drawbacks of the previously known solutions, according to the invention there is provided a method of making a shell-mould for a casting, comprising the following successive steps:

(a) providing a pattern of the article to be cast;

(b) depositing an adhesion agent on said pattern;

(c) depositing thereon a layer of a ceramic suspension from a fluid slip;

(d) drying said pattern after said deposition step (c);

(e) depositing a further layer of ceramic suspension on said pattern from the same fluid slip as previously used in step (c);

(f) depositing ceramic particles in stucco form on said pattern after step (e);

(g) drying said pattern after said deposition step (f);

(h) repeating steps (e) to (g) as many times as is necessary to obtain the desired thickness and mould characteristics; and (i) heat treating the mould thus formed on said pattern to bake and consolidate the mould by sintering and to dispose of said pattern.

Preferably, the adhesion agent deposited on the pattern in step (b) comprises a 3% solution of an aminosilane in a solvent consisting of a mixture of ethanol and ethyl acetate in proportions such that each constitutes between 25% and 75% of the solvent.

DESCRIPTION OF THE PREFERRED EMBODIMENTS

Example 1

A solvent product is prepared by mixing ethanol and ethyl acetate. Tests carried out with various proportions of the components have established that the acceptable proportions of each of the constituents are between 25% and 75% of the mixture. It was particularly observed that alcohol alone reacts with the adhesion agent used and makes it ineffective in less than 24 hours, whereas ethyl acetate alone leads to a deterioration of the surface condition of a wax pattern by dissolution. In contrast, the mixing of these two constituents in the ratios stated limits the harmful reactions.

A solution is formed by adding to the said solvent 3% of an adhesion agent of an aminosilane. Various commercial products supplied by Dynamit Nobel under the trade names of Dynasilan 1505 or AMMO, for example, have been successfully tested. The solution obtained exhibits good stability and has a sealed can life of several weeks.

Step (b) of the method of making a shell mould in accordance with the invention consists of depositing the adhesion agent on the pattern of the article to be cast (which has already been made from wax or other suitable material), and may be carried out as follows:

(b1) immersing the pattern in the above described solution for at least 3 to 4 minutes;

(b2) removing the solvent from the solution deposited on the pattern by evaporation to ambient air; and, if desired, (b3) then rinsing the pattern with water to eliminate any drain lines or excess adhesion agent; and (b4) drying the rinsed pattern in ambient air.

The effectiveness of the adhesion agent thus deposited on the pattern is retained for about 24 hours, and reactivation is possible simply by repeating the procedure (b1) to (b4) described above.

After this deposition of the adhesion agent the next stage of the method is step (c), i.e. the deposition of a layer of a ceramic suspension by dipping the pattern in a fluid slip, followed by the drying step (d).

By not having to use a thick slip to produce the first ceramic layer on the pattern as in previously known processes, the method of the invention avoids various disadvantages associated with the use of a thick slip;

because of its density, a thick slip requires the use of a special mixer for its preparation;

its stability is less assured and difficulties are experienced in checking and keeping a thick slip constant because of the appreciable development in the course of time of its rheological characteristics and its PH; and a dipping process using a robot is impractical, in contrast to when using a fluid slip as in the invention.

Then, as many times as is necessary to obtain the desired thickness and mould characteristics, the following steps of the method of the invention are repeated:

(e) deposition of a further layer of ceramic suspension from the same fluid slip as previously used in step (c) to produce the first layer;

(f) deposition of ceramic particles in stucco form; and (g) drying the coated pattern, The use of a fluid slip right from the first dipping of the pattern (step (b) of the method of the invention) permits a better coating of the pattern to be obtained in the confined parts or the areas of difficult access during dipping operations, and also a better control of the deposited thickness when draining. The bonding of the stucco particles is effected on a second layer reinforcing the first dry layer originating from the fluid slip, thus preventing the stucco from penetrating the first layer to come into contact with the wax of the pattern and damage its surface condition. Whatever type of stucco is used, fine or coarse, there has been observed, as a result, an improvement of some 30% in the roughness of the surface condition of the shell obtained.

From this example of the method in accordance with the invention it has been possible to verify numerous advantages of depositing an adhesion agent on the pattern in the implementation of the method, some of which have already been mentioned, and in particular:

cutting out the addition of surface active agents in the slips and the drawbacks deriving therefrom;

achievement of a bond between the surfaces of the pattern and the shell exhibiting good mechanical resistance; and greater tolerance with respect to drying conditions.

Other embodiments of the method in accordance with the invention are of course possible.

The effectiveness of the adhesion agent has been tested on several waxes and on a pattern material of rhodoid type.

The tests described above were carried out using slips in the form of aqueous suspensions comprising a colloidal silica based binder. However, applications may also be envisaged using suspensions in an alcohol medium, particularly when using slips comprising ethyl silicate.

The method of applying the solution of the adhesion agent to the pattern may involve immersion of the pattern in the solution as described above, or the pattern may be sprinkled or sprayed with the solution.

Moreover, apart from the commercial products mentioned, the adhesion agent may be obtained from any other product of amino-silane type.

Finally, it will be noted that it is a further advantage of the method in accordance with the invention that, by restricting deposition of the adhesion agent to certain selected zones of the pattern, it is possible to deposit a ceramic coating on only these parts of interest of the pattern.

Depending on manufacturing constraints the present invention can also be applied to existing methods utilizing a thick slip. In this case the method will include the preliminary step of depositing the adhesion agent on the pattern before the ceramic deposition from the thick slip. This provides the advantage of improved adhesion at the wax/ceramic interface and avoids subsequent decoherence, particularly in the event of overdrying.

We claim:

1. A method of making a shell-mould for a casting, comprising the following successive steps:

(a) providing a wax pattern of an article to be cast;

(b) depositing an adhesion agent on said wax pattern;

(c) depositing thereon a layer of ceramic suspension from a fluid slip;

(d) drying said pattern after said deposition step (c);

(e) depositing a further layer of ceramic suspension on said pattern from said fluid slip;

(f) depositing ceramic particles in stucco form on said pattern following step (e);

(g) drying said pattern after said deposition step (f);

(h) repeating steps (e) to (g) to obtain desired mould characteristics for a particular application of said shell mould; and (i) heat treating said shell-mould thus formed on said pattern to bake and consolidate said shell-mould by sintering and to dispose of said pattern; wherein said adhesion agent deposited on said pattern in step (b) comprises a 3% solution of an amino-silane in a solvent consisting of a mixture of ethanol and ethyl acetate in proportions such that each constitutes from 25% to 75% of said solvent, to thus provide for improved adhesion of said layer of said ceramic suspension to said wax pattern and thus avoid subsequent decoherence of said shell-mould from said wax pattern.

2. A method according to claim 1, wherein step (b) comprises the sub-steps:

(b1) immersing said pattern in said solution for at least 3 to 4 minutes; and (b2) removing said solvent from said solution deposited on said wax pattern by evaporation to ambient air.

3. A method according to claim 2, wherein step (b) comprises the further sub-steps:

(b3) rinsing said wax pattern with water after sub-step (b2) to eliminate any drain lines or excess adhesion agent; and (b4) drying said rinsed pattern in ambient air.

4. A method according to claim 1, wherein step (b) comprises sprinkling said wax pattern with said solution.

5. A method of making a shell-mould for a casting, comprising the following successive steps:

(a) providing a wax pattern of an article to be cast;

(b) depositing an adhesion agent on said wax pattern;

(c) depositing thereon a layer of ceramic suspension from a thick slip;

(d) depositing ceramic particles in stucco form on said pattern following step (c);

(e) drying said pattern after said deposition step (d); and (f) repeating steps (c) to (e) to obtain desired mould characteristics for a particular application of said shell-mould;

wherein said adhesion agent deposited on said pattern in step (b) comprises a 3% solution of an amino-silane in a solvent consisting of a mixture of ethanol and ethyl acetate in proportions such that each constitutes from 25% to 75% of said solvent, to thus provide for improved adhesion of said layer of said ceramic suspension to said wax pattern and thus avoid subsequent decoherence of said shell-mould from said wax pattern.

6. A method according to claim 5, wherein step (b) comprises the sub-steps:

(b1) immersing said wax pattern in said solution for at least 3 to 4 minutes; and (b2) removing said solvent from said solution deposited on said wax pattern by evaporation to ambient air.

7. A method according to claim 6, wherein step (b) comprises the further sub-steps:

(b3) rinsing said wax pattern with water after sub-step (b2) to eliminate any drain lines or excess adhesion agent; and (b4) drying said rinsed pattern in ambient air.

8. A method of making a shell-mould for a casting, comprising the following successive steps:

(a) providing a pattern of an article to be cast;

(b1) immersing said pattern for at least 3 to 4 minutes in an adhesion agent comprising a 3% solution of an amino-silane in a solvent consisting of a mixture of ethanol and ethyl acetate in proportions such that each constitutes from 25% to 75% of said solvent, to thereby deposit said adhesion agent on said pattern;

(b2) evaporating said solvent from said solution deposited on said pattern;

(b3) rinsing said pattern and said adhesion agent with water to eliminate any drain lines or excess adhesion agent;

(b4) drying said rinsed pattern;

(c) depositing on said dried pattern and adhering to said dried pattern by said adhesion agent, a first layer of a ceramic suspension from a fluid slip;

(d) drying said first layer of said ceramic suspension and said pattern;

(e) depositing from said fluid slip a second layer of said ceramic suspension on said first layer of said ceramic suspension on said pattern;

(f) depositing ceramic particles in stucco form on said second layer of said ceramic suspension on said pattern;

(g) drying said pattern having said first layer and said second layer of said ceramic suspension and said ceramic particles deposited thereon;

(h) repeating steps (d) to (g) to obtain desired mould characteristics for a particular application of said shell-mould; and (i) sintering said dried layers of said ceramic suspension and said ceramic particles of said shell-mould thus formed on said pattern to bake and consolidate said shell-mould and to dispose of said pattern.

9. A method of making a shell-mould for a casting, comprising the following successive steps:

(a) providing a pattern of an article to be cast;

(b1) immersing said pattern for at least 3 to 4 minutes in an adhesion agent comprising a 3% solution of an amino-silane in a solvent consisting of a mixture of ethanol and ethyl acetate in proportions such that each constitutes from 25% to 75% of said solvent, to thereby deposit said adhesion agent on said pattern;

(b2) evaporating said solvent from said solution deposited on said pattern;

(b3) rinsing said pattern and said adhesion agent with water to eliminate any drain lines or excess adhesion agent;

(b4) drying said rinsed pattern;

(c) depositing on said dried pattern and adhering to said dried pattern by said adhesion agent, a first layer of a ceramic suspension from a thick slip;

(d) drying said first layer of said ceramic suspension and said pattern;

(e) depositing from said thick slip a second layer of said ceramic suspension on said first layer of said ceramic suspension on said pattern;

(f) depositing ceramic particles in stucco form on said second layer of said ceramic suspension on said pattern;

(g) drying said pattern having said first layer and said second layer of said ceramic suspension and said ceramic particles deposited thereon;

(h) repeating steps (e) to (g) to obtain desired mould characteristics for a particular application of said shell-mould; and (i) sintering said dried layers of said ceramic suspension and said ceramic particles of said shell-mould thus formed on said pattern to bake and consolidate said shell-mould and to dispose of said pattern.

* * * * *

UNITED STATES PATENT AND TRADEMARK OFFICE

CERTIFICATE OF CORRECTION

PATENT NO. : 5,159,970

DATED : NOVEMBER 3, 1992

INVENTOR(S) : NADINE BURKARTH ET AL

It is certified that error appears in the above-identified patent and that said Letters Patent is hereby corrected as shown below:

Column 2, line 49, change "Dynasilan" to --DYNASILAN--;
line 59, after "above", insert -- - --.

Column 3, line 16, change "PH" to --pH--.

Signed and Sealed this

Sixteenth Day of November, 1993

*Attest:*

*Attesting Officer*

Bruce Lehman

BRUCE LEHMAN

*Commissioner of Patents and Trademarks*